US008416234B2

(12) United States Patent
Mizukoshi et al.

(10) Patent No.: US 8,416,234 B2
(45) Date of Patent: Apr. 9, 2013

(54) COMPENSATING VOLTAGE DROP FOR DISPLAY DEVICE

(75) Inventors: Seiichi Mizukoshi, Kanagawa (JP); Makoto Kohno, Kanagawa (JP); Kouichi Onomura, Yokohama (JP); Nobuyuki Mori, Saitama (JP)

(73) Assignee: Global OLED Technology, LLC, Wilmington, DE (US)

( * ) Notice: Subject to any disclaimer, the term of this patent is extended or adjusted under 35 U.S.C. 154(b) by 640 days.

(21) Appl. No.: 12/393,435

(22) Filed: Feb. 26, 2009

(65) Prior Publication Data

US 2009/0225072 A1 Sep. 10, 2009

(30) Foreign Application Priority Data

Mar. 7, 2008 (JP) ..... 2008-058078

(51) Int. Cl.
*G09G 5/00* (2006.01)

(52) U.S. Cl.
USPC ..... 345/214

(58) Field of Classification Search ..... None
See application file for complete search history.

(56) References Cited

U.S. PATENT DOCUMENTS 5,990,629 A * 11/1999 Yamada et al. ..... 315/169.3
6,768,482 B2 * 7/2004 Asano et al. ..... 345/90
6,943,501 B2 9/2005 Kobayashi
6,961,111 B1 * 11/2005 Kuramasu ..... 349/152
7,208,294 B2 * 4/2007 Tanabe ..... 435/78
7,277,071 B2 * 10/2007 Oh ..... 345/76
7,324,101 B2 * 1/2008 Miyazawa ..... 345/211
7,893,625 B2 * 2/2011 Suh et al. ..... 315/160
7,973,745 B2 * 7/2011 Mizukoshi et al. ..... 345/76
2007/0128583 A1 6/2007 Miyazawa

FOREIGN PATENT DOCUMENTS

JP 2003-027999 1/2003

* cited by examiner

*Primary Examiner* — K. Wong

(74) *Attorney, Agent, or Firm* — McKenna Long & Aldridge, LLP

(57) ABSTRACT

To compensate for voltage drop on a power supply line. In a display device, pixel data is supplied to each of a plurality of pixels arranged in a matrix form and display is performed. Each pixel has a self-emissive element. A horizontal direction power supply line (horizontal direction PVDD) which supplies a power supply to each pixel is provided, and one end of the horizontal PVDD line is connected to a vertical power supply line (vertical PVDD line) that is connected to an external power supply terminal. Correction data corresponding to a voltage drop to the horizontal PVDD line due to a resistance in the vertical PVDD line is then obtained through a calculation based on pixel data, and the input pixel data is corrected using the correction data so as to reduce the influence of the voltage drop on the pixel current.

9 Claims, 17 Drawing Sheets

COMPENSATING VOLTAGE DROP FOR DISPLAY DEVICE

CROSS-REFERENCE TO RELATED APPLICATION

This application claims priority of Japanese Patent Application No. 2008-058078 filed Mar. 7, 2008 which is incorporated herein by reference in its entirety.

FIELD OF THE INVENTION

The present invention relates to a display device for writing pixel data to each of a number of pixels arranged in a matrix shape, and performing display.

BACKGROUND OF THE INVENTION

FIG. 1 shows the structure of a circuit for one pixel section (pixel circuit) of a basic active organic EL display device, and FIG. 2 shows one example of the structure of a display panel, and signals input to the display panel.

As shown in FIG. 2, a pixel data signal, a horizontal sync signal, a pixel clock and other drive signals are supplied to a source driver 10. Also, the horizontal sync signal, a vertical sync signal and other drive signals are supplied to a gate driver 12. Vertical direction data lines Data extend from the source driver 10 to each column of the pixel section 14, while horizontal direction gate lines Gate extend from the gate driver 12 to each row of the pixel section 14.

As shown in FIG. 1, a pixel circuit includes a selection TFT 2 having a source or a drain connected to a data line Data and a gate connected to a gate line Gate, a drive TFT 1 with the drain or source of the selection TFT 2 connected to a gate, and a source connected to a power supply PVdd, a storage capacitor C connected across the gate and source of the drive TFT 1, and an organic EL element 3 having an anode connected to the drain of the drive TFT 1, and a cathode connected to a low voltage power supply CV.

A data signal is stored in the storage capacitor C by setting a gate line (Gate), that extends in the horizontal direction, to a high level to turn the selection TFT 2 on, and in this state placing a data signal having a voltage corresponding to a display brightness on a data line (Data) that extends in the vertical direction. In this way, the drive TFT 1 supplies a drive current corresponding to the data signal stored in the storage capacitor C to the organic EL element 3, and the organic EL element 3 emits light.

Here the amount of light emission and current of the organic EL element 3 are in a substantially proportional relationship. Normally, a voltage (Vth) is supplied across the gate of the drive TFT 1 and PVdd such that a drain current approaching that for a black level of the pixel starts to flow. Also, the amplitude of the image data signal is an amplitude so as to give a prescribed brightness close to a white level. Specifically, a voltage supplied to the data line Data is controlled using the image data signal so that a current flows in the organic EL element 3 in a range from a black level to a white level.

An image signal formed from data of a plurality of bits (for example 8 bits) for each pixel section 14, a horizontal sync signal (HD) indicating the end of 1 line, a pixel clock indicating the end of data for each pixel of the image data signal, a vertical sync signal (VD) indicating the end of each frame, and other drive signals are input to the display panel. An image data signal, horizontal sync signal, pixel clock and other drive signals are input to the source driver 10, and image data signals corresponding to data line Data that has been set for each pixel column are sequentially supplied to the source driver 10. Also, a horizontal sync signal, vertical sync signal and other drive signals are input to the gate driver 12, and a gate line Gate of a corresponding row is selected at the timing for supplying image data signals for pixels of each row from the source driver 10 to the data line Data. In this way, image data signals for each pixel section 14 are written to that pixel section 14, and display is carried out.

FIG. 3 shows a relationship for CV current (corresponding to brightness) flowing in the organic EL element 3 with respect to input signal voltage (voltage of the data line Data (data voltage)) of the drive TFT 1. It is possible to carry out appropriate gradation control for the organic EL element 3 by determining the image data signal so that Vb is supplied as the black level voltage and Vw is supplied as the white level voltage.

In this manner, the input signal voltage of the pixel, and the current flowing in the organic EL element 3 of that pixel, are not in a proportional relationship. Therefore, as shown in FIG. 4, RGB signals rn, gn and bn for every pixel, being the image data signal that is input, are input to three corresponding gamma correction circuits (γLUT) 16, and here a relationship between the image data signal and the brightness is made linear. In FIG. 4, the RGB image data signals rn, gn and bn are corrected using respective look-up table type gamma correction circuits (γLUT) 16. Corrected image data signals Rn, Gn and Bn are input to the source driver 10. In FIG. 4, the source driver 10 is formed using a shift register 10*a* and a data latch and D/A 10*b*. Specifically, image data signals are sequentially input to the shift register 10*a* of the source driver 10, synchronously converted to an analog signal in the data latch and D/A 10*b* once there is image data for one horizontal line, and supplied to the data line Data. In the display panel 18, regions where display is carried out are shown as the display panel (effective pixel region) 18.

Here, in the pixel circuit of FIG. 1 stray capacitance and resistance components accompanying wiring are not shown, but in actual fact these cannot be disregarded with respect to the characteristics and are formed as distributed constant circuits. As shown in FIG. 2, a plurality of pixel sections 14 are connected to a PVDD line for supplying power supply voltage to each pixel, and so if there is a resistance component there will be variation in the voltage of the source of the transistor (drive TFT 1) for driving the organic EL element, according to the magnitude of the current of other pixels. That is, as current of pixels that are connected to the same PVDD line increases, lowering of voltage will increase. If the selection TFT 2 is turned ON and there is a lowering of the source voltage during writing of a Data voltage to the storage capacitor C, an absolute value of Vgs will drop, which shows that pixel current is reduced and emission brightness is lowered, and as a result it is difficult to perform display in accordance with Data voltage.

In order to solve this problem, in U.S. Patent Application Publication No. 2007/0128583 a transistor for turning off current for pixels while writing is added, and voltage drop for horizontal lines is prevented.

As described above, due to current flowing in power supply lines, which have a resistance component, power supply voltage for the pixel circuit drops, and the display brightness becomes non-uniform. For example, if a white image is displayed over the whole of a panel having power supply lines arranged, as shown in FIG. 6, power supply voltage drop occurs with the distribution shown in the drawing. In particular, in the case where a white window pattern is displayed on a grey background, as shown in FIG. 5, as the left and right (sections b and c) of the window approach the window they become darker than other background sections (sections d and e), and boundaries with other sections are conspicuous.

With U.S. Pat. No. 6,943,501 and JP 2003-027999A, it is assumed that it is possible to ignore the resistance of vertical direction power supply lines on one or both sides of a panel, and power supply lines are drawn out in a horizontal scanning direction parallel to the pixels, and voltage lowering due to resistance of power supply lines in this horizontal direction is obtained by calculation, to correct input data. In the event that left and right vertical direction power supply lines are formed on an array substrate forming the panel, it is necessary to broaden the width in order to lower resistance, which affects the external width of the panel. Also, in the case where it is not possible to ensure sufficient width, voltage drop in the y-y' direction in FIG. 6 occurs, and brightness becomes non-uniform in the vertical direction.

SUMMARY OF THE INVENTION

The present invention is characterized by a display device that supplies pixel data to pixel elements arranged in a matrix form, to perform display, wherein each pixel includes a self-emissive element, a first direction power supply line which supplies a power supply to each pixel is provided for each line along a first direction of the pixel, and each end of the first direction power supply line is connected to a second direction power supply line which is connected to an external power supply terminal and which is perpendicular to the first direction, and correction data corresponding to a voltage drop to each first power supply line due to a resistance in the second direction power supply line is obtained through a calculation based on pixel data, and input pixel data is corrected with correction data so as to reduce influence of the voltage drop on the pixel current.

Also, it is suitable for the first direction to be a horizontal scanning direction with the first power supply line being a horizontal power supply line, and for the second direction to be a vertical scanning direction with the second power supply line being a vertical power supply line.

It is also suitable to provide memory, for single frame period saving of calculated current values of current flowing in each horizontal power supply line, for every vertical power supply line, and for voltage drops to horizontal lines m of each vertical power supply line to be calculated sequentially, from an initial line 1 to a final line M, based on a voltage drop to a horizontal line m−1 that was obtained in a previous calculation, current flowing into each horizontal power supply line calculated from pixel data for one frame before, current flowing into horizontal power supply lines 1 to m calculated from pixel data for lines 1 to m of the current frame, and resistance of the vertical power supply line.

It is also suitable for the vertical power supply lines to be arranged on either side of a pixel section having pixels arranged in a matrix form, and for current flowing into a horizontal power supply line m to be calculated based on current for all pixels of that line calculated from pixel data for that horizontal line, a difference between voltage drops at both ends of the horizontal power supply line m immediately before that pixel data is written, and resistance of the horizontal power supply line.

It is also suitable for the vertical power supply lines to be arranged at one side of a pixel section having pixels arranged in a matrix form, and current flowing into a horizontal power supply line m to be calculated based on current for all pixels of that line calculated from pixel data for that horizontal line.

It is also suitable to have a gamma correction structure, for making a relationship between input pixel data and pixel current linear, and for correction to be performed by calculating pixel data before gamma correction and pixel data after gamma correction in association with pixel current for respective pixels and data voltage input to a pixel circuit, and adding calculated correction data to, or subtracting calculated correction data from, data after gamma correction.

It is also suitable for each pixel to include a plurality of sub-pixels, and for the same correction data to be used in sub-pixels constituting the same pixel.

It is also suitable for the self-emissive element provided in each pixel to be an organic EL element.

As has been described above, according to the present invention, since voltage drop with current supply to each pixel of a power supply line is appropriately estimated, it is possible to carry out display by appropriately compensating data supplied to every pixel.

DETAILED DESCRIPTION OF THE INVENTION

Embodiments of the present invention will be described in the following based on the drawings.

Figure 6:
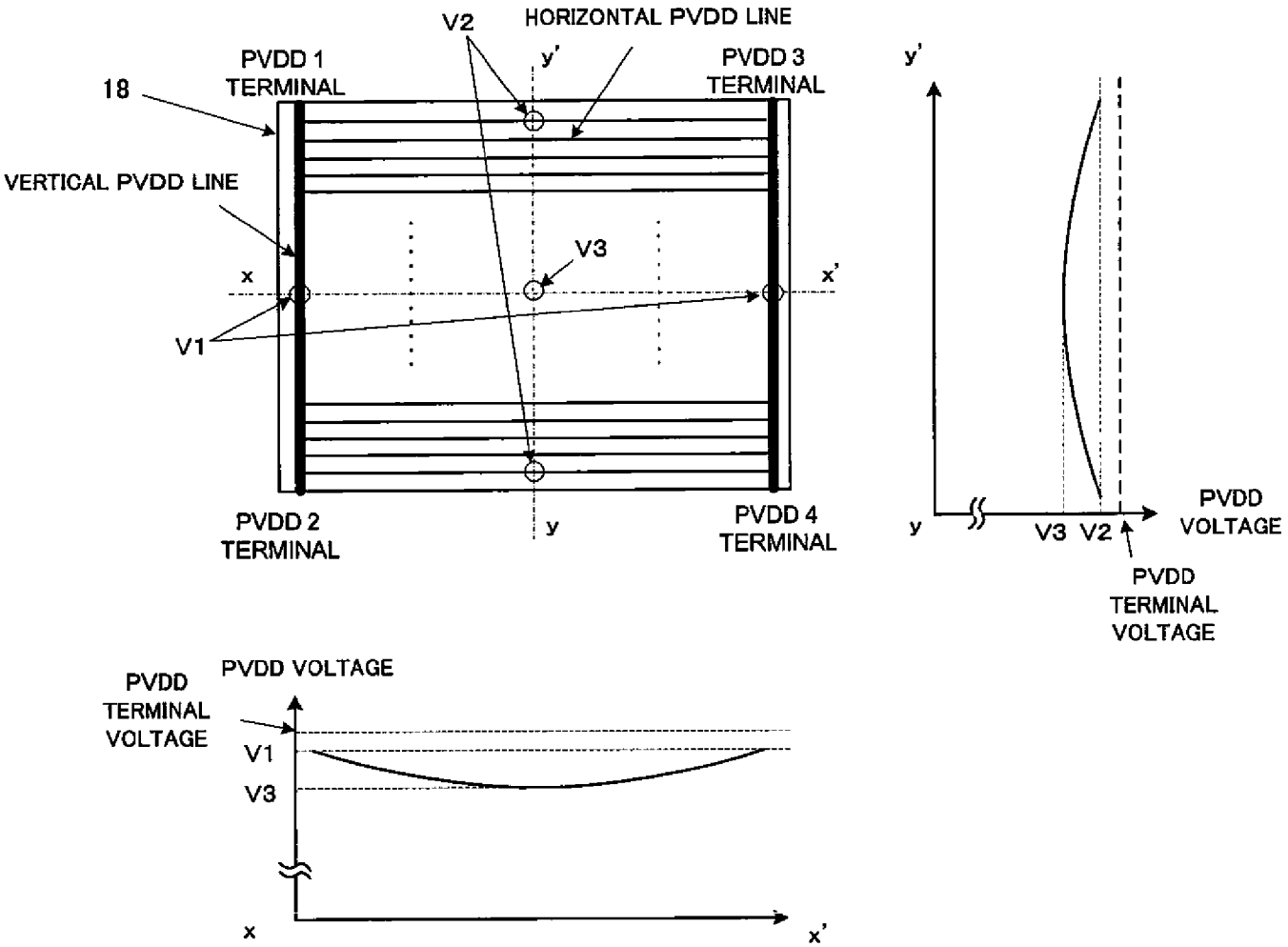
FIG. 6 is a drawing showing voltage drop of a specified pixel.
Figure 7:
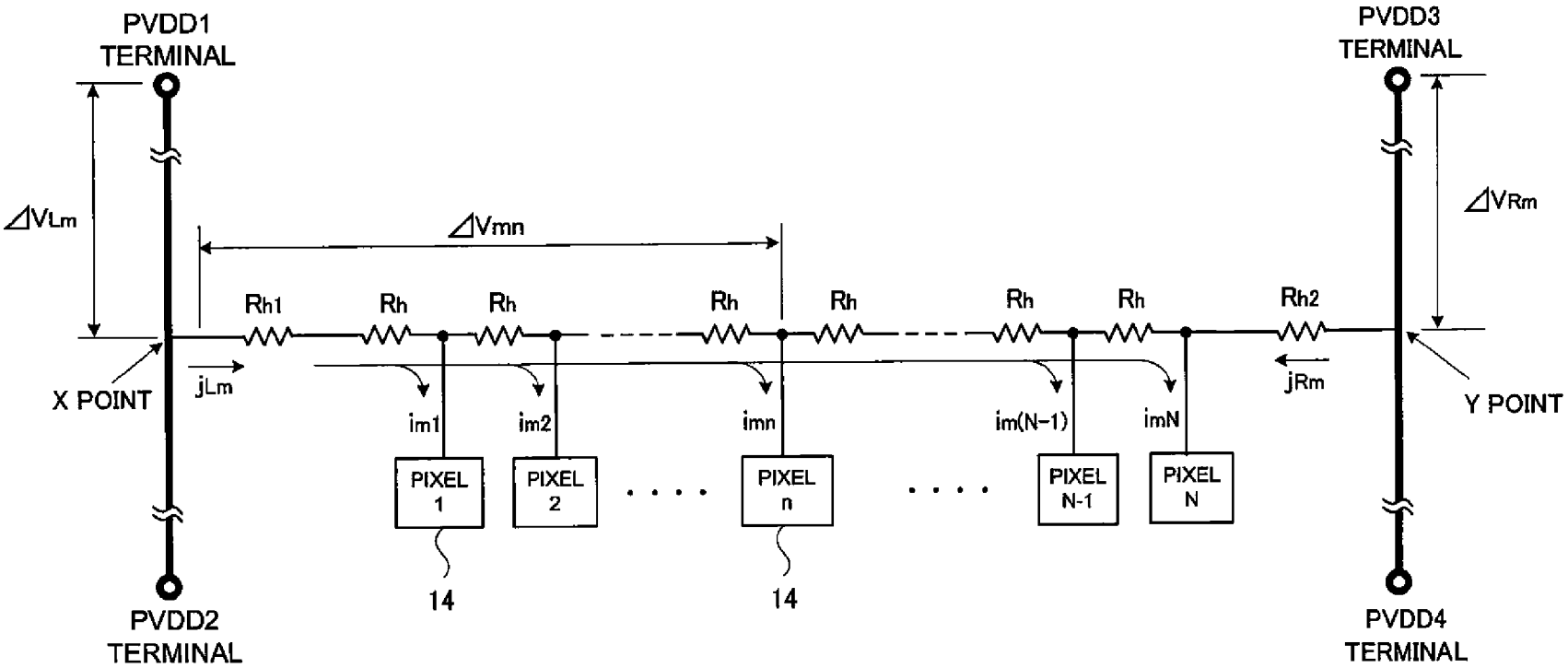
FIG. 7 is a drawing showing voltage drop of each pixel in a horizontal line direction.

FIG. 6 shows an arrangement example for power supply lines (PVDD lines) of a display panel 18 having organic EL elements arranged in each pixel, and PVDD terminals, being terminals of those power supply lines. Also, FIG. 7 shows an equivalent circuit relating to resistance components of one horizontal line, and FIG. 8 shows an equivalent circuit relating to resistance components of vertical lines.

Resistances of power supply lines (horizontal PVDD lines) between horizontal pixels, and resistances of vertical power supply lines (vertical PVDD lines) between horizontal lines, are made the same, and are respectively Rh and Rv. Also, it is considered that a distance from a left end section X point of a horizontal PVDD line, and a right end section Y pint, to a pixel is different from an inter pixel distance, and resistances are also different to Rh, and are respectively made Rh1+Rh, and Rh2. Ends of the vertical power supply lines are also similarly different from the resistance between lines, and this resistance is made Rv1+Rv and Rv2.

First of all, it is assumed that voltages at the X point and Y point of an $m^{th}$ line are determined, and a voltage drop $\Delta V_{mn}$ for from the X point to a pixel n is obtained. Next, a voltage drop $\Delta V_{Lm}$ for from a PVDD terminal that includes the voltage drop of the vertical power supply line to the X point is obtained and added to $\Delta V_{mn}$, to obtain a voltage drop to the pixel n. If this voltage is added to a signal voltage and input to the panel, a target pixel current flows. Actually, the voltages of the X point and Y point gradually change with every rewrite of the horizontal pixel signal from top to bottom. This is because a current value flowing in a horizontal line varies gradually with pixel data content, and the vertical direction voltage drop changes. Accordingly, voltages at the X point and the Y point are calculated in the following procedure.

Figure 8:
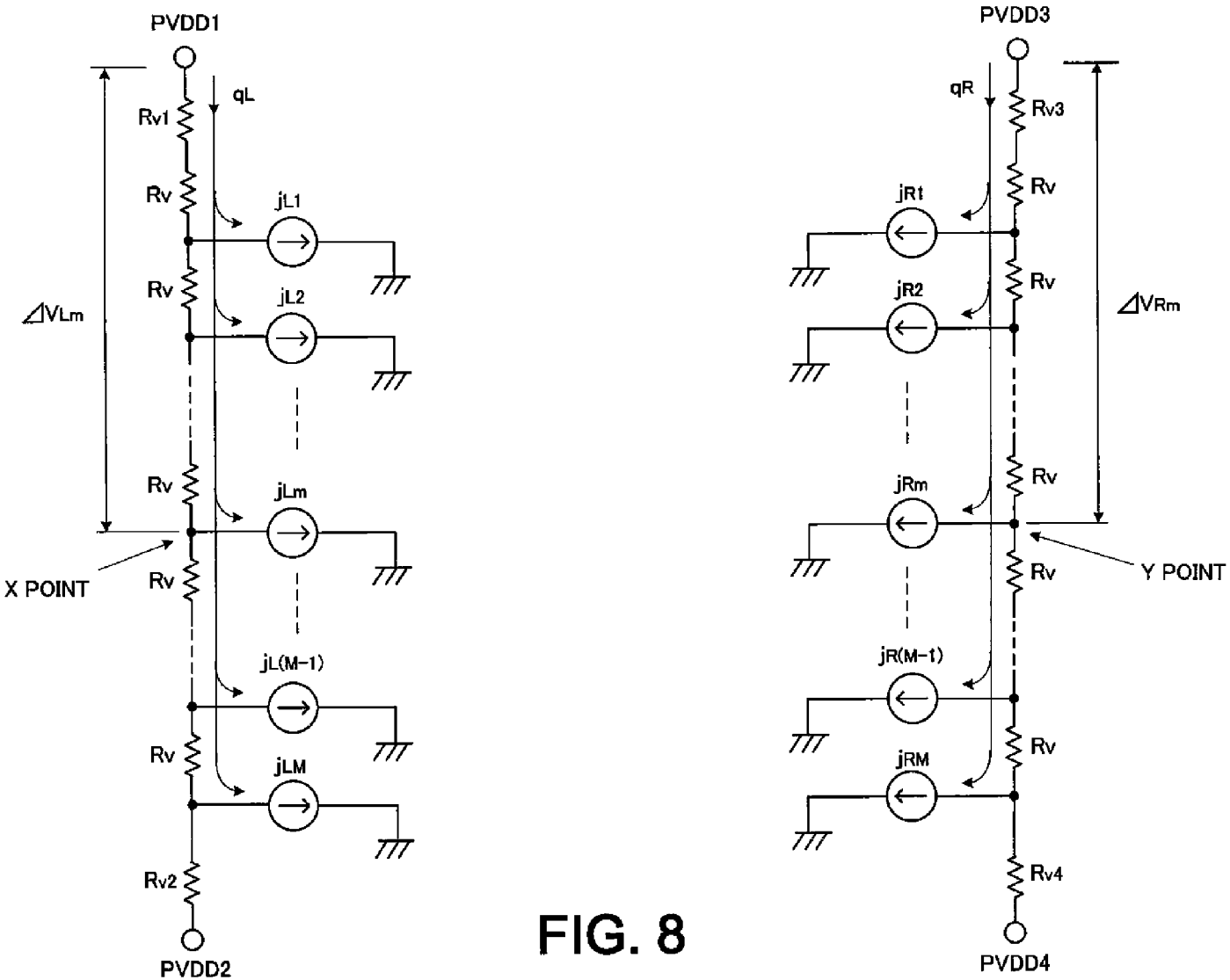
FIG. 8 is a drawing showing voltage drop of a vertical power supply line.

If an initial image is made completely black, then in FIG. 8 $j_{L1}$~$j_{LM}$ and $j_{R1}$~$j_{RM}$ are all 0. As a result, it is considered that $\Delta V_{L1}$ and $\Delta V_R$ are 0, and using this voltage value $j_{L1}$ and $j_{R1}$ at the time of writing new data to the pixel of the 1st line is obtained. Next, before writing data of the second line, due to the effect of $j_{L1}$ and $j_{R1}$, $\Delta V_{L2}$ and $\Delta V_{R2}$ are not 0, and this voltage is calculated using $\Delta V_{L2}$ and $\Delta V_{R2}$ resultantly acquired, $i_{L2}$ is obtained. Similarly, voltage drop and current value of each line is successively calculated up to the lowermost line, such as to obtain $\Delta V_{L3}$ and $\Delta V_{R3}$ considering $j_{L1}$ and $j_{L2}$, and $j_{R1}$ and $j_{R2}$. Further, at the first line of the next frame, $\Delta V_{L1}$ and $\Delta V_{R1}$ are newly obtained from $j_{L1}$~$j_{LM}$ and $j_{R1}$~$j_{RM}$ that were obtained in the previous frame, and current is calculated using these values and new pixel data. At the second line, $\Delta V_{L2}$ and $\Delta V_{R2}$, and $j_{L2}$ and $j_{R2}$, are obtained from this $j_{L1}$, $j_{R1}$, and from $j_{L2}$~$j_{LM}$ and $j_{R2}$~$j_{RM}$ of the previous frame. In this manner, current is calculated using voltage at both ends of a horizontal line, and newly written pixel data, and successively updated.

To be precise, for every write of new horizontal line data, voltages of both ends of that line are changed by the current of that line itself, and a proportion of current flowing from the left and right of current flowing in other horizontal power supply lines varies. Specifically, if the image changes significantly, there will be variation in the voltage distribution of left and right vertical power supply lines. If the total resistance of the left and right vertical power lines is a few Ω and the total resistance of the horizontal power supply lines (horizontal PVDD) is a few KΩ, the effect is comparatively small, and if there is no image variation errors gradually reduce for every repetition of a frame update and finally converge, so that they will be hardly noticeable visually. Also, there is no effect on the brightness of horizontal lines to which data has already been written. This is because since there is no change in the potential of both ends of the storage capacitor, a current value at the time if writing is maintained.

SPECIFIC EXAMPLE

First of all, a voltage drop ($\Delta V_{mn}$) from an X point of a horizontal line m to a pixel is represented using $\Delta V_{m(n-1)}$, as in the following equation.

$$\begin{aligned}
\Delta V_{m0} &= j_{Lm} R_{h1} \\
\Delta V_{m1} &= \Delta V_{m0} + j_{Lm} R_h \\
\Delta V_{m2} &= \Delta V_{m1} + (j_{Lm} - i_{m1}) R_h \\
\Delta V_{m3} &= \Delta V_{m2} + (j_{Lm} - i_{m1} - i_{m2}) R_h \\
&\vdots \\
\Delta V_{mn} &= \Delta V_{m(n-1)} + \left( j_{Lm} - \sum_{k=1}^{n-1} i_{mk} \right) R_h.
\end{aligned} \qquad \text{Equation 1}$$

Here, $j_{Lm}$ is current flowing from the PVDD line on the left of FIG. 7, and is expressed by the following equation if voltages of the X point and Y point are respectively made PVDD−$\Delta V_{Lm}$ and PVDD−$\Delta V_{Rm}$.

$$\begin{aligned}
jLm = {} & \frac{im1(N-1)Rh + Rh2)}{NRh + Rh1 + Rh2} + \\
& \frac{im2\{(N-2)Rh + Rh2\}}{NRh + Rh1 + Rh2} + \frac{im3\{(N-3)Rh + Rh2)}{NRh + Rh1 + Rh2} + \\
& \ldots + \frac{imNRh2}{NRh + Rh1 + Rh2} + \frac{\Delta VLm - \Delta VRm}{NRh + Rh1 + Rh2} = \\
& \frac{1}{NRh + Rh1 + Rh2} \left( \Delta VRm - \Delta VLm + \sum_{k=1}^{N} imk\{(N-k)Rh + Rh2\} \right).
\end{aligned} \qquad \text{Equation 2}$$

Next, voltage drop for the vertical PVDD line is obtained.

In FIG. 8, a voltage drop ($\Delta VL_m$) of a left side vertical PVDD line from a PVDD1 terminal to a horizontal line m can be represented using $\Delta V_{L(m-1)}$, as in the following equation.

$$\begin{aligned}
\Delta V_{L0} &= q_L R_{v1} \\
\Delta V_{L1} &= \Delta V_{L0} + q_L R_v \\
\Delta V_{L2} &= \Delta V_{L1} + (q_L - j_{L1}) R_v \\
\Delta V_{L3} &= \Delta V_{L2} + (q_L - j_{L1} - j_{L2}) R_v \\
&\vdots \\
\Delta V_{Lm} &= \Delta V_{L(m-1)} + \left( q_L - \sum_{k=1}^{m-1} j_{Lk} \right) R_v.
\end{aligned} \qquad \text{Equation 3}$$

Here, $q_L$ is current flowing in from PVDD1, and, if the same voltage is applied to both PVDD1 and PVDD2, is represented by the following equation.

$$qL = \frac{jL1((M-1)Rv + Rv2)}{MRv + Rv1 + Rv2} + \frac{jL2\{(M-2)Rv + Rv2\}}{MRv + Rv1 + Rv2} + \qquad \text{Equation 4}$$

-continued $$\ldots + \frac{jLm((M-m)Rv + Rv2)}{MRv + Rv1 + Rv2} + \frac{j'L(m+1)\{(M-m-1)Rv + Rv2\}}{MRv + Rv1 + Rv2} + \frac{j'L(m+2)\{(M-m-2)Rv + Rv2\}}{MRv + Rv1 + Rv2} + \ldots + \frac{j'LMRv2}{MRv + Rv1 + Rv2} = \frac{1}{MRv + Rv1 + Rv2}\left(\sum_{k=1}^{m} jLk\{(M-k)Rv + Rv2\} + \sum_{k=m+1}^{M} j'Lk\{(M-k)Rv + Rv2\}\right) = \frac{1}{MRv + Rv1 + Rv2}\left(\sum_{k=1}^{m} (jLk - j'Lk)\{(M-k)Rv + Rv2\} + \sum_{k=1}^{M} j'Lk\{(M-k)Rv + Rv2\}\right)\Bigg).$$

Here, $j'_{Lm}$ is current that flowed in to the horizontal power supply line m from the left side vertical power supply line one frame previous.

Current flowing from the right side vertical PVDD line to the horizontal PVDD line is obtained if $j_{Lm}$ is subtracted from the sum of currents of all pixels of horizontal line m. Specifically:

$$jRm = \sum_{k=1}^{N} imk - jLm. \quad \text{Equation 5}$$

For voltage drop of the right side vertical PVDD line, if $j_{Rm}$ is used, then similarly to $j_{Lm}$:

$$\begin{aligned} \Delta V_{R0} &= q_R R_{v3} \quad \text{Equation 6} \\ \Delta V_{R1} &= \Delta V_{R0} + q_R R_v \\ \Delta V_{R2} &= \Delta V_{R1} + (q_R - j_{R1})R_v \\ \Delta V_{R3} &= \Delta V_{R2} + (q_R - j_{R1} - j_{R2})R_v \\ &\vdots \\ \Delta V_{Rm} &= \Delta V_{R(m-1)} + \left\{q_R - \sum_{k=1}^{m-1} j_{Rk}\right\}R_v. \end{aligned}$$

Here, if $j'_{Rm}$ is current that flowed in to the horizontal power supply line m from the right side vertical power supply line one frame previous, then $q_R$ is given by:

$$qR = \frac{1}{MRv + Rv3 + Rv4}\left(\sum_{k=1}^{m} jRk\{(M-k)Rv + Rv4\} + \sum_{k=m+1}^{M} j'Rk\{(M-k)Rv + Rv4\}\right) = \frac{1}{MRv + Rv3 + Rv4}\left(\sum_{k=1}^{m} (jRk - j'Rk)\{(M-k)Rv + Rv4\} + \sum_{k=1}^{M} j'Rk\{(M-k)Rv + Rv4\}\right)\Bigg). \quad \text{Equation 7}$$

By substituting and $\Delta V_{Lm}$ & $\Delta V_{Rm}$ that were obtained with equation 3 and equation 6 into $\Delta V_{mn}$ of equation 1, the voltage drop from the X point to the power supply PVdd of the pixel is obtained. If $\Delta V_{mn}$ and $\Delta V_{Lm}$ are added, and then added to an absolute value of input signal voltage and input to the panel, a target pixel current flows.

Since the image data ($D_{mn}$) before D/A conversion, and the pixel drive voltage (Data line voltage $V_{mn}$) have a proportional relationship, if a proportional constant is made A, then they can be represented as $D_{mn}=AV_m$, $\Delta D_{mn}=A\Delta V_m$, $\Delta D_{Lm}=A\Delta V_{Lm}$, and $\Delta D_{Rm}=A\Delta V_{Rm}$. Also, in a display device having a gamma correction function for making a relationship between input data and pixel current linear, pixel current ($i_{mn}$) is in a proportional relationship with the image data ($d_{mn}$) before gamma correction, and so if a proportional constant is made K, there is the representation of $i_{mn}=Kd_{mn}$. If $J_{Lm}=Aj_{Lm}$, it is possible to rewrite equation 1 to equation 3 as follows using image data before and after correction by the γLUT.

From equation 1, the following is derived.

$$\Delta D_{mn} = \Delta D_{m(n-1)} + \left(J_{Lm} - AK\sum_{k=1}^{n-1} d_{mk}\right)R_h. \quad \text{Equation 8}$$

However, $\Delta D_{m0}=J_{Lm}R_{h1}$.

From equation 2, the following is derived.

$$JLm = \frac{1}{NRh + Rh1 + Rh2}\left(\Delta DRm - \Delta DLm + AK\sum_{k=1}^{N} dmk\{(N-k)Rh + Rh2\}\right). \quad \text{Equation 9}$$

From equation 3, the following is derived:

$$\Delta D_{Lm} = \Delta D_{L(m-1)} + \left(Q_L - \sum_{k=1}^{m-1} J_{Lk}\right)R_v. \quad \text{Equation 10}$$

However, $\Delta D_{L0}=Q_L R_{v1}$

Here, $Q_L$ can be represented as follows:

$$Q_L = \frac{1}{MR_v + R_{v1} + R_{v2}}\left(\sum_{k=1}^{m} (J_{Lk} - J'_{Lk})\{(M-k)R_v + R_{v2}\} + \sum_{k=1}^{M} J'_{Lk}\{(M-k)R_v + R_{v2}\}\right). \quad \text{Equation 11}$$

Here, $J'_{Lm}$ corresponds to current that flowed in to the horizontal line m from the left side power supply line one frame previous.

Similarly, if $J_{Rm}=Aj_{Rm}$, the following is derived from equation 5.

$$J_{Rm} = AK\sum_{k=1}^{N} d_{mk} - J_{Lm}. \quad \text{Equation 12}$$

From equation 6 the following is derived.

$$\Delta D_{Rm} = \Delta D_{R(m-1)} + \left(Q_R - \sum_{k=1}^{m-1} J_{Rk}\right)R_v. \quad \text{Equation 13}$$

However, $\Delta D_{R0}=Q_R R_{v3}$

Here, $Q_R$ can be represented as follows.

$$QR = \frac{AK}{MRv + Rv3 + Rv4}\left(\sum_{k=1}^{m}(JRk - J'Rk)\{(M-k)Rv + Rv4\} + \sum_{k=1}^{M} J'Rk\{(M-k)Rv + Rv4\}\right). \quad \text{Equation 14}$$

Figure 9:
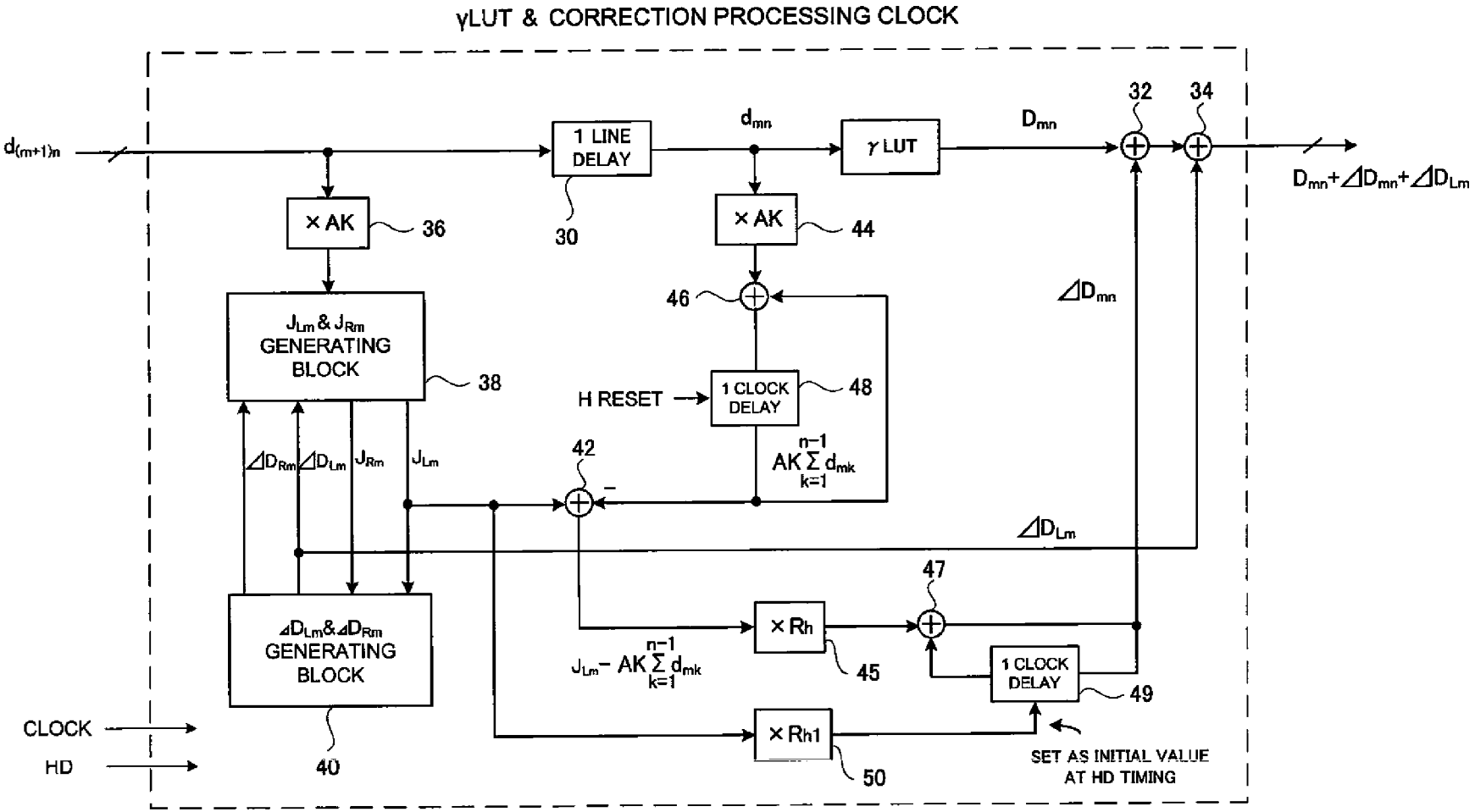
FIG. 9 is a drawing showing the structure of γLUT and correction calculation.
Figure 10:
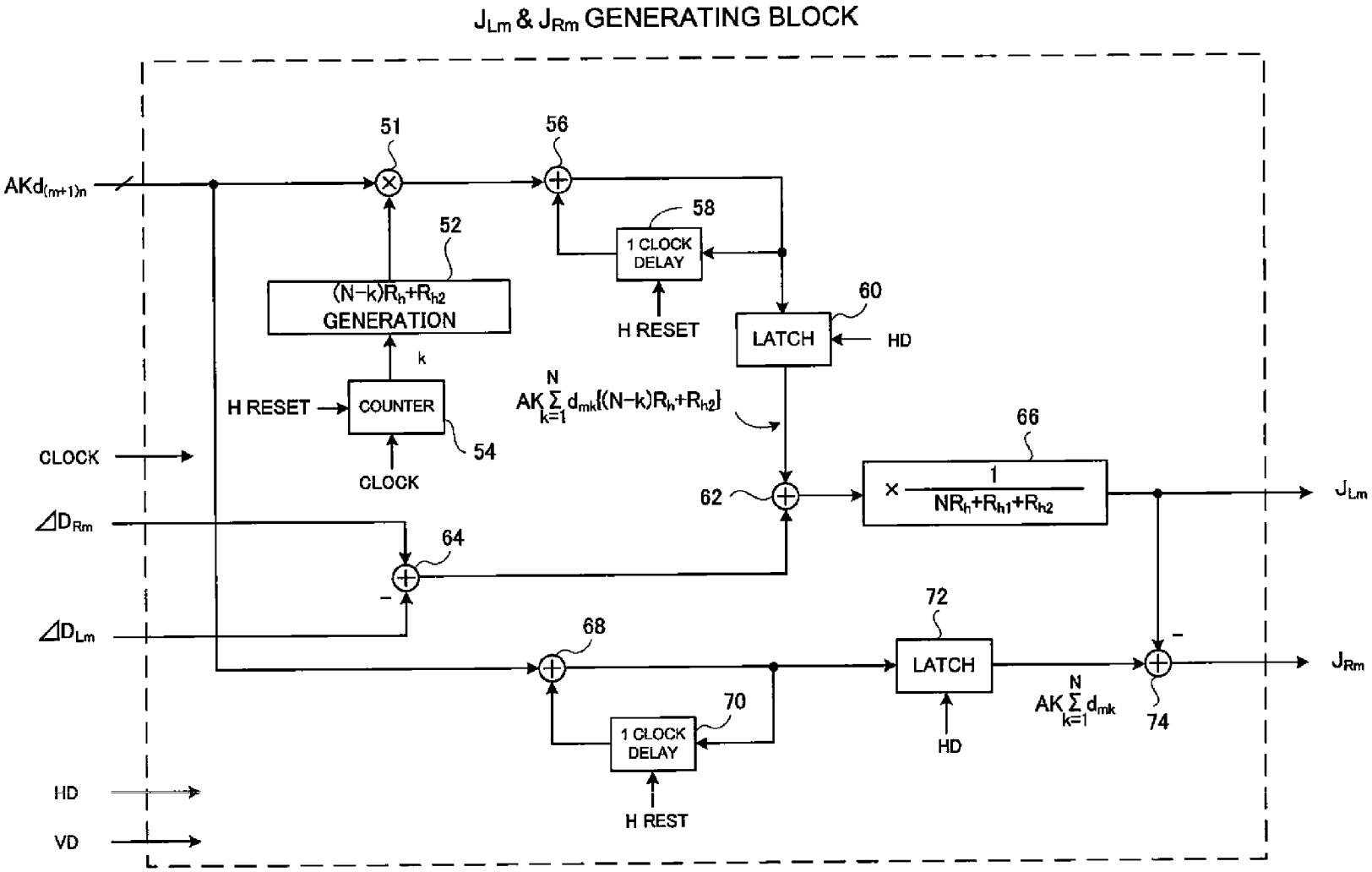
FIG. 10 is a drawing showing the structure of a $J_{Lm}$ & $J_{Rm}$ generating block.
Figure 11:
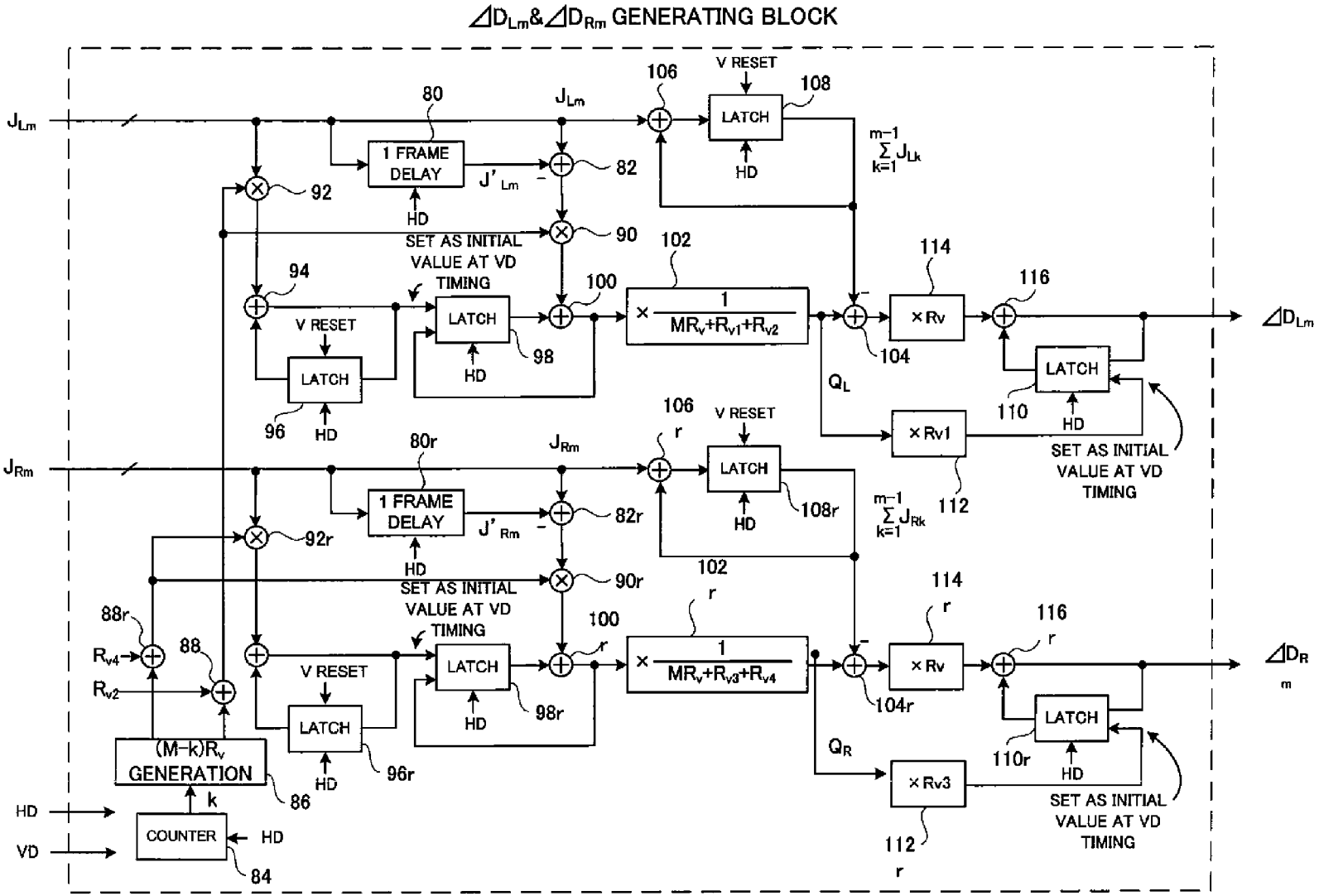
FIG. 11 is a drawing showing a structural example of a $\Delta D_{mn}$ & $\Delta D_{Lm}$ generating block.

FIG. 9 to FIG. 11 show one example of a compensation circuit for realizing the above equations. As shown in FIG. 9, data (m+1 line, $n^{th}$ row data $d_{(m+1(n)}$) is input. Data $d_{mn}$ of one line previous is output to the output of a one-line delay circuit 30, this data $d_{mn}$ is supplied to the γlook-up table γLUT, to give γ corrected data $D_{mn}$. Respective correction values $\Delta D_{mn}$ and $\Delta D_{Lm}$ are added to this data $D_{mn}$ in the adders 32 and 34, and data after correction $D_{mn}+\Delta D_{mn}|\Delta D_{Lm}$ is output.

Also, for calculation of correction value, data $d_{(m+1)n}$ is multiplied by the above-described two proportional constants A and K by the multiplier 36, and then supplied to a $J_{Lm}$ & $J_{Rm}$ generating block 38. The obtained $J_{Lm}$ and $J_{Rm}$ are supplied to a $\Delta D_{mn}$ & $\Delta D_{Lm}$ generating block 40, where $\Delta D_{mn}$ and $\Delta D_{Lm}$ are obtained, and these are fed back to the $J_{Lm}$ & $J_{Rm}$ generating block 38. Also, $\Delta D_{Lm}$ generated by the $\Delta D_{mn}$ & $\Delta D_{Lm}$ generating block 49 is supplied to the above described adder 34.

$J_{Lm}$ that has been generated by the $J_{Lm}$ & $J_{Rm}$ generating block 38 is supplied to the adder 42. Here, after the output $d_{mn}$ of the one-line delay circuit 30 has been multiplied by constant Ak by the multiplier 44, at the adder 46, it is added to an addition result of that adder 46 that has been delayed by one clock by the one-clock delay circuit 48. Accordingly, $AK\Sigma d_{mk}$ (k=1~n−1), which is a cumulative value, is obtained at the output of the one-clock delay circuit 48. This $AK\Sigma d_{mk}$ (k=1~n−1) is supplied to the adder 42 as a minus value, and therefore $J_{Lm}-AKd_{mk}$ (k=1~n−1) is obtained at the output of the adder 42. Output of this adder 42 is multiplied by Rh, and then supplied to the adder 47. In this adder 47 data that is that adder output returned by way of the one-clock delay circuit 48 is added, and so a cumulative calculation output is obtained. Also, $J_{Lm}$, which is the output of the $J_{Lm}$ & $J_{Rm}$ generating block, is multiplied by Rh1, and set in the one-clock delay circuit 48 as an initial value at the beginning of the first line. Accordingly, for first pixel data, $J_{Lm}R_{h1}$ is output from the adder 47, and for subsequent pixels a value according to $\Delta D_{mn}=\Delta D_{m(n\ 1)}+(J_{Lm}-AK\Sigma d_{mk}$ (k=1~n−1)) $R_h$ is output, and this is supplied to the adder 32.

FIG. 10 shows a structural example of the $J_{Lm}$ & $J_{Rm}$ generating block 38. $AKd_{(m+1)n}$, which is the output of the multiplier 36, is supplied to a multiplier 51, and here it is multiplied by $(N-k)R_h+R_{h2}$ from the $(N-k)R_h+R_{h2}$ generating section 52. A count number k from the counter 54 is supplied to this $(N-k)R_h+R_{h2}$ generating section 52.

Output of the multiplier 51 is supplied to the adder 56, and here added to output of a one-clock delay circuit 58 that delays the output of the adder 56 by one clock, to give a cumulative calculation, and this cumulative calculation is latched in the latch 60 in synchronism with the horizontal sync signal HD. As a result, output of this latch 60 becomes $AK\Sigma d_{mk}\{(N-k)R_h+R_{h2}\}$ (k=1~N), and this is maintained for one horizontal period. Output of the adder 64 is supplied to the adder 62. This adder 64 subtracts $\Delta D_{Lm}$ from $\Delta D_{Rm}$ supplied from the $\Delta D_{mn}$ & $\Delta D_{Lm}$ generating block 40, and supplies $\Delta D_{Rm}-\Delta D_{Lm}$ to the adder 62. Output of the adder 62 is then multiplied by $1/(NR_h+R_{h1}+R_{h2})$ to give $J_{Lm}$, which is output (refer to equation 9).

Also, $AKd_{(m+1)n}$ is supplied to adder 68, where it is accumulated by adding to output of the adder 68 that has been delayed by the one-clock delay circuit 70, output of this adder 68 is latched by a latch 72 at the timing of the horizontal sync signal, to obtain $AK\Sigma d_{mk}$ (k=1~N), and then A $K\Sigma d_{mk}$ (k=1~N) is supplied to an adder 74 where $J_{Lm}$ is subtracted to obtain $J_{Rm}$ (refer to equation 12), which is output.

FIG. 11 shows the structure of the $\Delta D_{Lm}$ & $\Delta D_{Rm}$ generating block 40. $J_{Lm}$ is supplied to a one-frame delay circuit, and $J'_{Lm}$ that is delayed by one frame in output from this one-frame delay circuit 80. This $J'_{Lm}$ is subtracted from $J_{Lm}$ by the adder 82, and supplied to the multiplier 90. $(M-k)R_v+R_{v2}$ is supplied to this multiplier 90, and $(J_{Lm}-J'_{Lm})\{(M-k)R_v+R_{v2}\}$ is obtained at the output of the multiplier 90. Here, k is generated by the counter 84 counting, and $(M-k)R_v+R_{v2}$ is generated by adding output of the $(M-k)R_v$ generating circuit 86 to $R_{v2}$ in the adder 88. $J_{Lm}$ is also supplied to the multiplier 92, and here it is multiplied by $(M-k)R_v+R_{v2}$. Output of this multiplier 92 is supplied to the adder 94, and output of the adder 94 is latched based on the horizontal sync signal HD, and connected to a latch 96 that is reset by a vertical reset signal (V reset), and output of the latch 96 is supplied to the adder 94. Accordingly, an addition result for a single vertical period is obtained at this adder 94, and this addition result is supplied as an initial value to the latch 98 at the timing of the horizontal sync signal HD. Specifically, the addition result of the previous frame is supplied at the start of the current frame.

Output of the latch 98 is supplied to the adder 100, and added to the output of the multiplier 90. Output of the multiplier 90 is then latched in the latch 98 in synchronism with the horizontal sync. signal HD. As a result, at this latch 98 $\Sigma J'_{Lk}\{(M-k)R_v+R_{v2}\}$ (k=1~M), which is the output of the adder 94, is latched at the start of one frame, and after that $\Sigma(J_{Lk}-J'_{Lk})\{(M-k)R_v+R_{v2}\}$ (k=1~m)+$\Sigma J'_{Lk}\{(M-k)R_v+R_{v2}\}$ (k=1~M), which is $\Sigma(J_{Lk}-J'_{Lk})\{(M-k)R_v+R_{v2}\}$ (k=1~m), being the cumulative result of adding the output of the multiplier 90 up to m, added to the initial value, is obtained as the output of the adder 100. In the multiplier 102 the output of the adder 100 is multiplied by $1/(MR_v+R_{v1}+R_{v2})$, to obtain $Q_L$ of equation 11.

$J_{Lm}$ is also supplied to the adder 106. Output of the adder 106 is connected to the latch 108 that is reset at the VD timing and latched by the horizontal sync signal HD, and output of the latch 108 is supplied to the adder 106. Therefore, there is a sum up to $J_{L(m-1)}$ at the latch 108, and $\Sigma J_{Lk}$ (k=1~m−1) is latched and output. At the same time, output of this latch 108 is input to the adder 104, and at the adder 104 subtracted from $Q_L$. Output of the adder 104 is multiplied by Rv at the multiplier 114, to obtain $(Q_L-\Sigma J_{Lk}\ (k=1\sim m-1))R_v$, and this is supplied to the adder 116. Output of the adder 116 is supplied back to the adder 116 via the latch 110 that is latched with the horizontal sync signal HD, and accumulated every horizontal line. Also, $Q_L$ is multiplied by $R_{v1}$ at the multiplier 112, and after that set as an initial value at the timing of the vertical sync signal VD for the start of the frame in the latch 110. Therefore, output of the multiplier 114 is sequentially added every horizontal line to the initial value $\Delta D_{L0}=Q_L R_{v1}$ from the multiplier 112, to obtain $\Delta D_{Lm}$ shown in equation 10.

Basically the same circuit is also provided for $J_{Rm}$. Specifically, instead of $J_{Lm}$, $J_{Rm}$ is supplied to a multiplier 92*r*, a one-frame delay circuit 80*r*, an adder 82*r* and an adder 106*r*, and $R_{v4}$ is supplied to adder 88*r* instead of $R_{v2}$, and besides this parts with the same reference numerals have the same configuration, and input signals are processed and output in the same way. As a result, $\Delta D_{Rm}$ is obtained at the output of the adder 116*r*.

Here, in FIG. 11, the one-frame delay circuits 80, 80*r* are constructed with memories of a size equivalent to the number (M) of vertical lines. For example, if $J'_{Lm}$ is 8 bits, it becomes M bytes and the required memory size is comparatively small. Also, since only data for one previous frame is used, it is possible to use a FIFO type memory.

Figure 1:
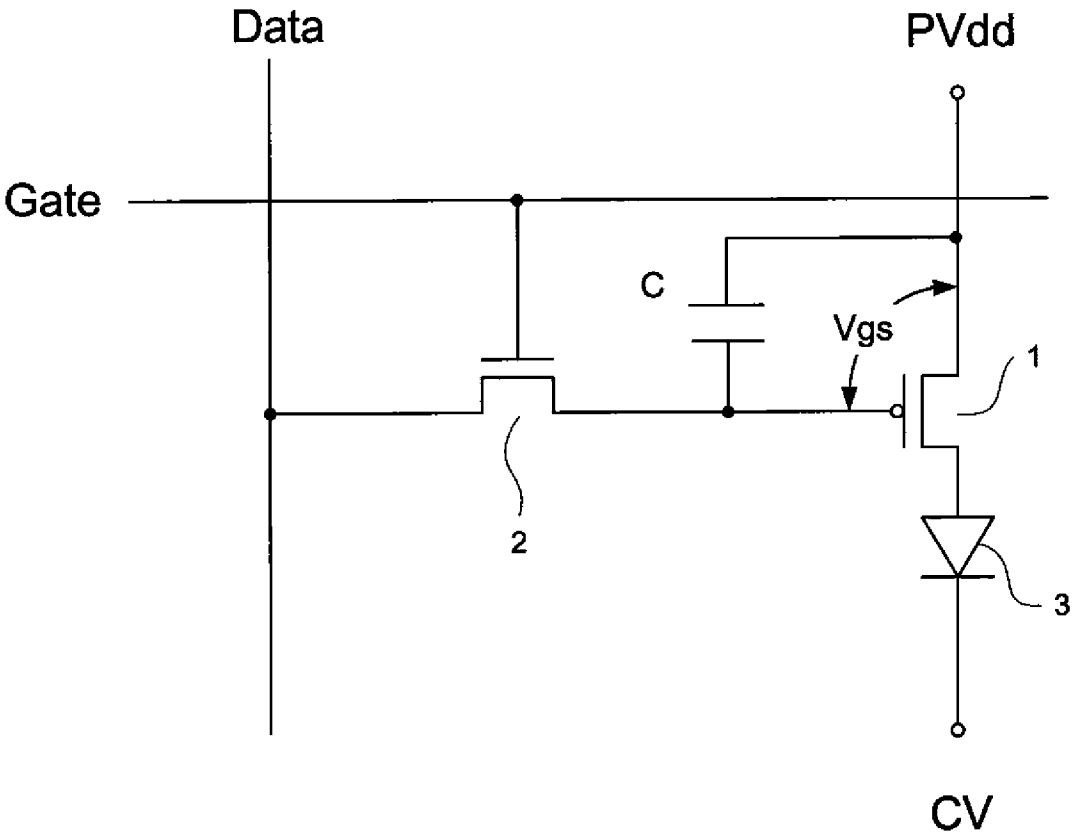
FIG. 1 is a drawing showing the structure of a pixel circuit.
Figure 2:
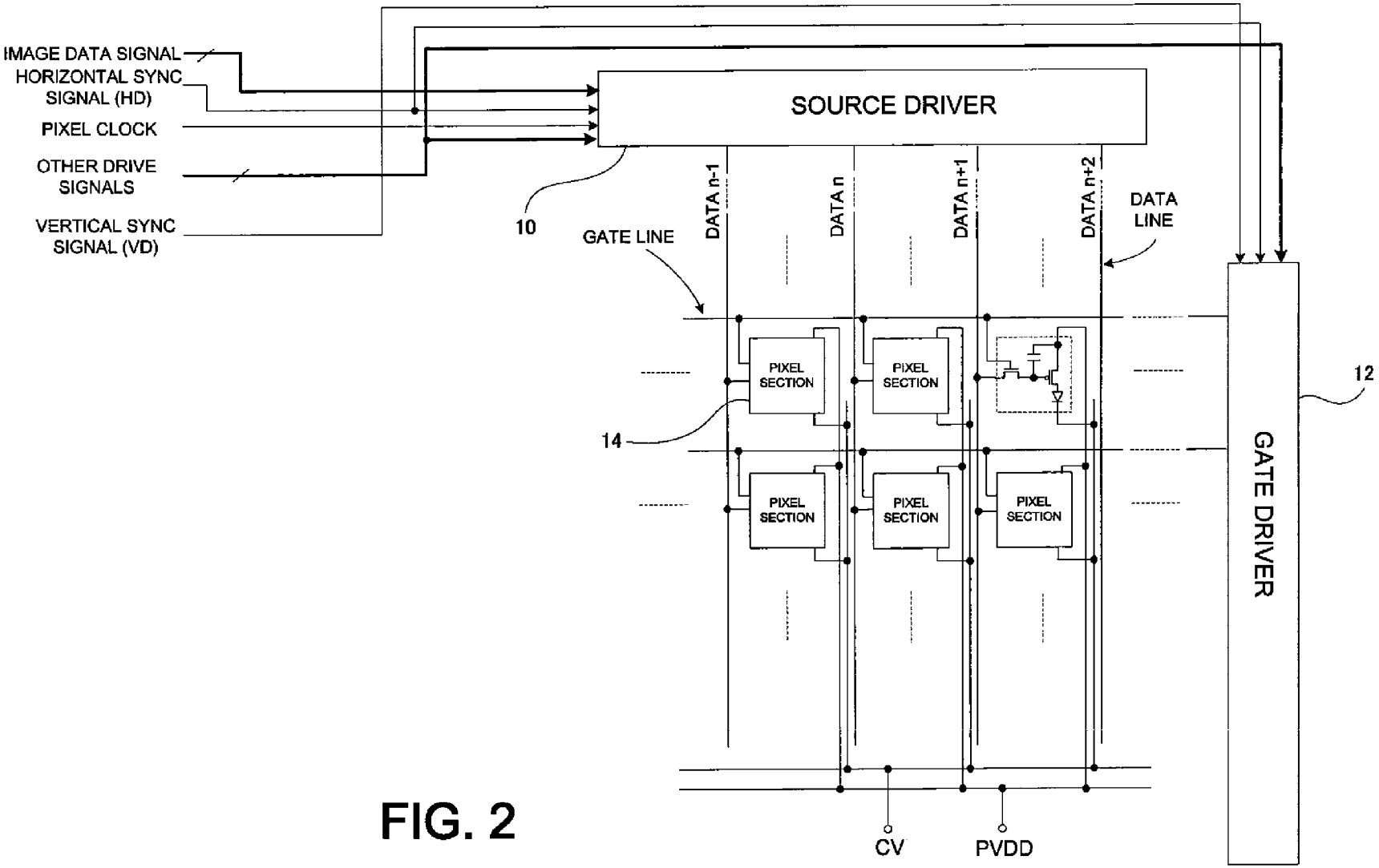
FIG. 2 is a drawing showing the structure of a display panel.
Figure 3:
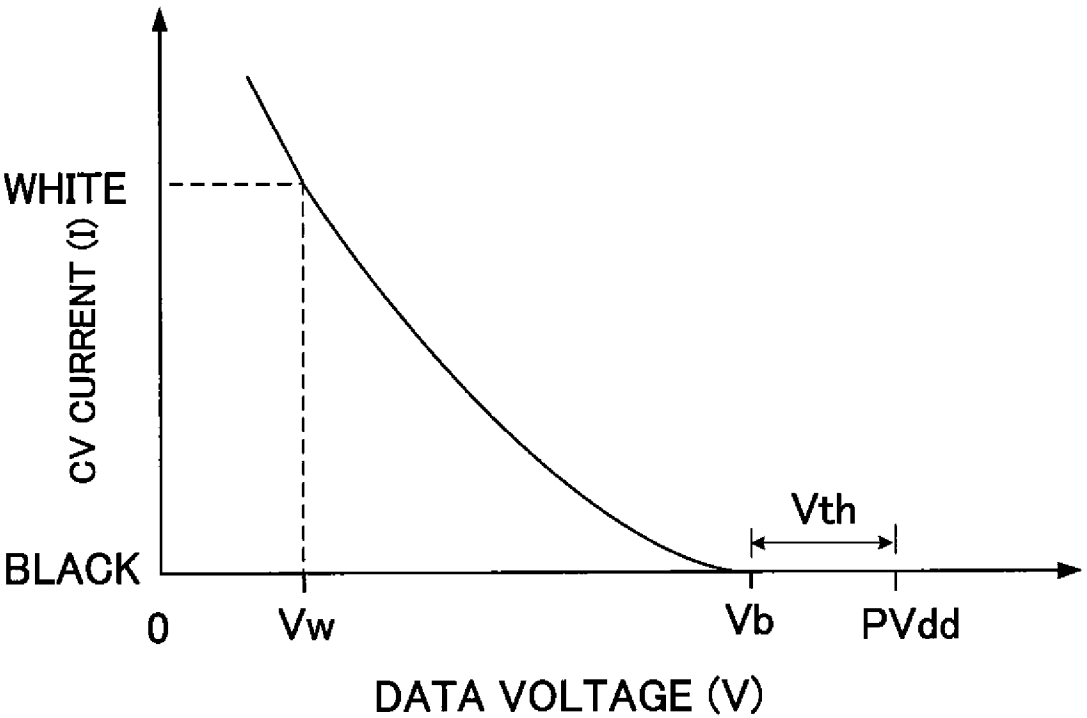
FIG. 3 is a drawing showing a relationship between current flowing in an organic EL element with respect to input signal voltage.
Figure 4:
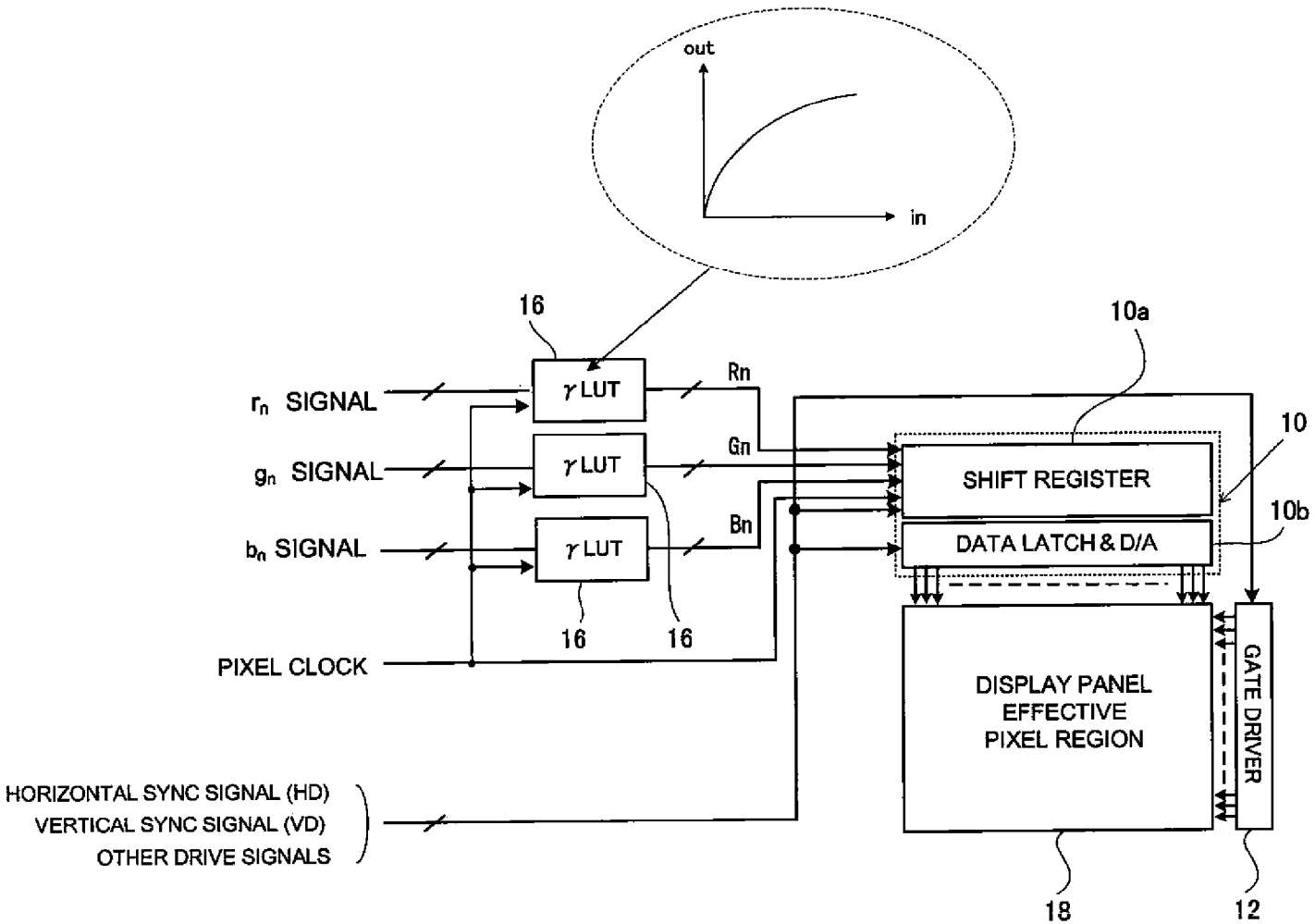
FIG. 4 is a drawing showing the structure of a display device including RGB signals.
Figure 5:
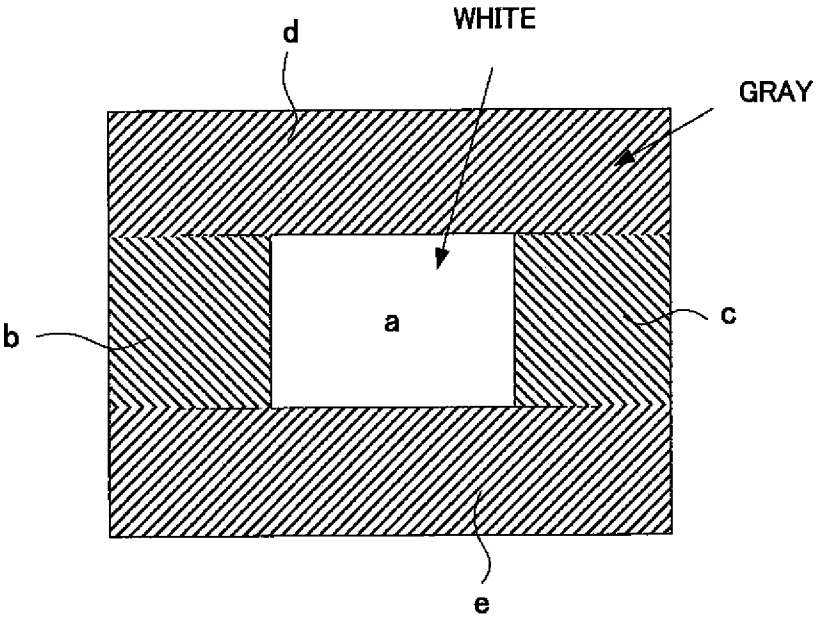
FIG. 5 is a drawing showing the display state of a display panel.
Figure 12:
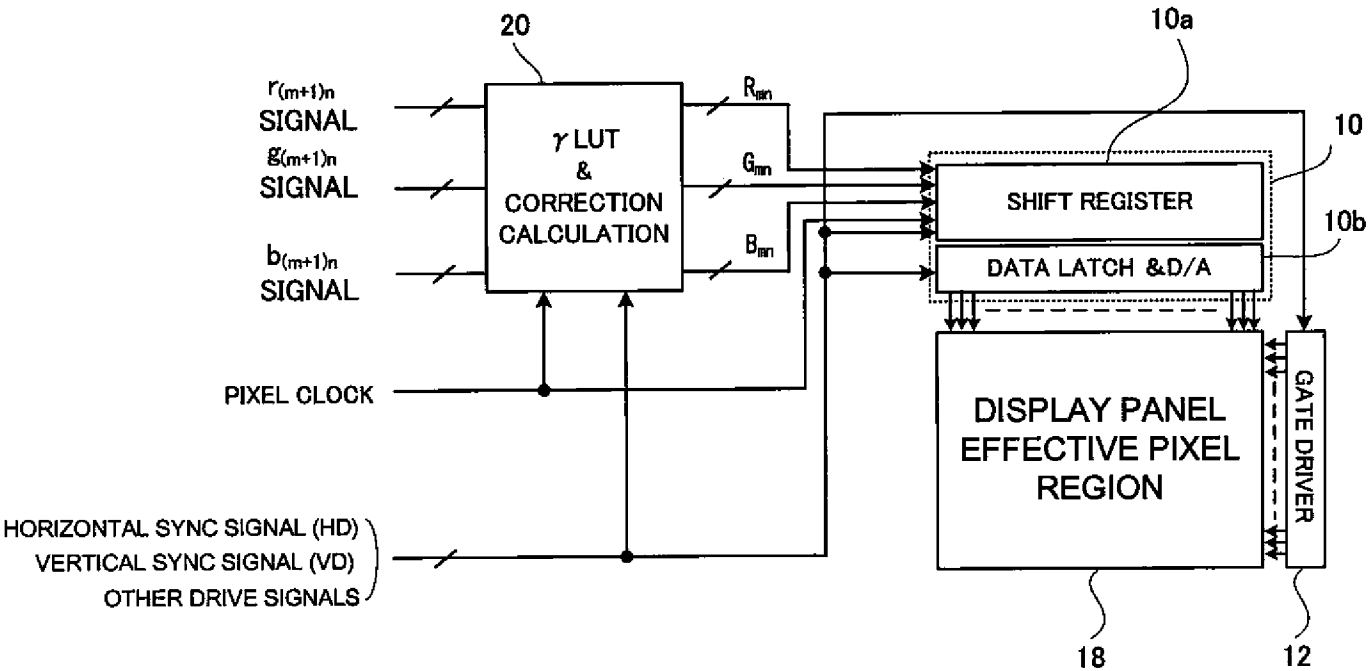
FIG. 12 is a drawing showing the structure of a display device including gamma correction and correction calculation.

FIG. 12 shows the overall structure of data signal correction and a display panel. It is basically the same as FIG. 4, with $r_{mn}$, $g_{mn}$ and $b_{mn}$, that are RGB signals for every pixel, being input to a γLUT and correction calculation circuit 20, but here it is not only subjected to gamma correction but also the above described correction calculation, and supplied to the source driver.

Here, in the case of a color display constructed using a plurality of fundamental colors, the efficiency of the organic EL elements normally differs according to color, and so a proportional constant K is different for each color. Accordingly, it is necessary to use a corresponding proportional constant K according to the color of the pixel.

Figure 13:
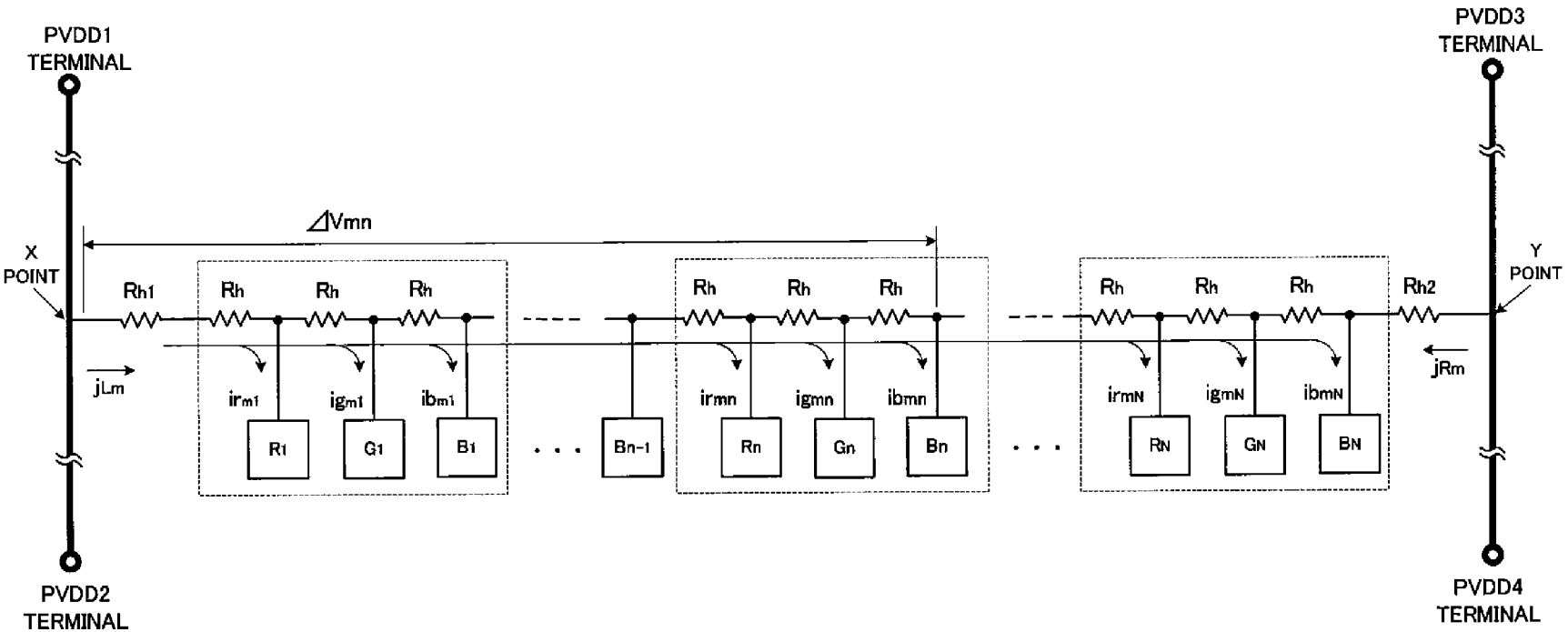
FIG. 13 is a drawing showing voltage drop of a power supply line including sub-pixels.
Figure 14:
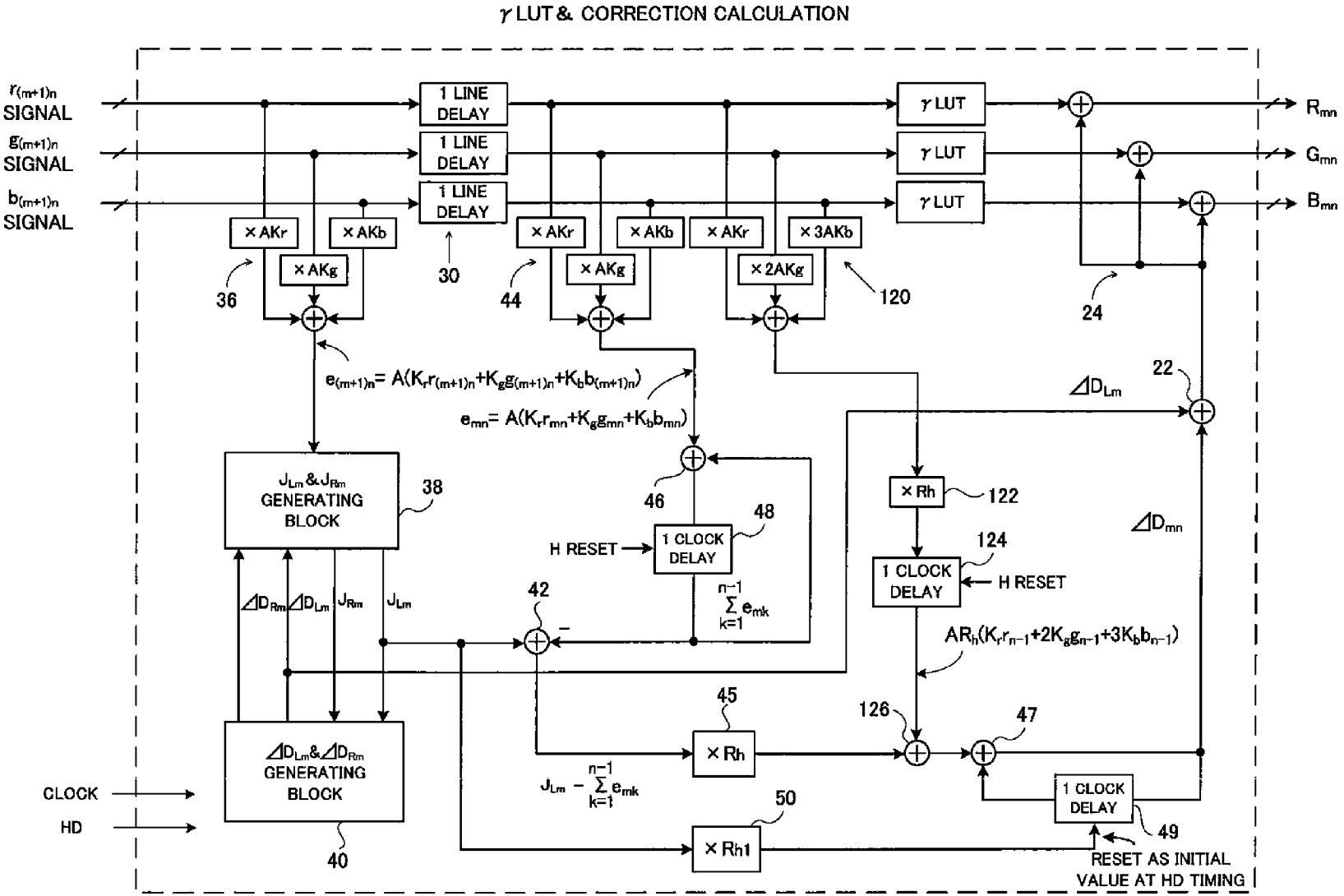
FIG. 14 is a drawing showing the structure of a γLUT and correction calculation circuit.
Figure 15:
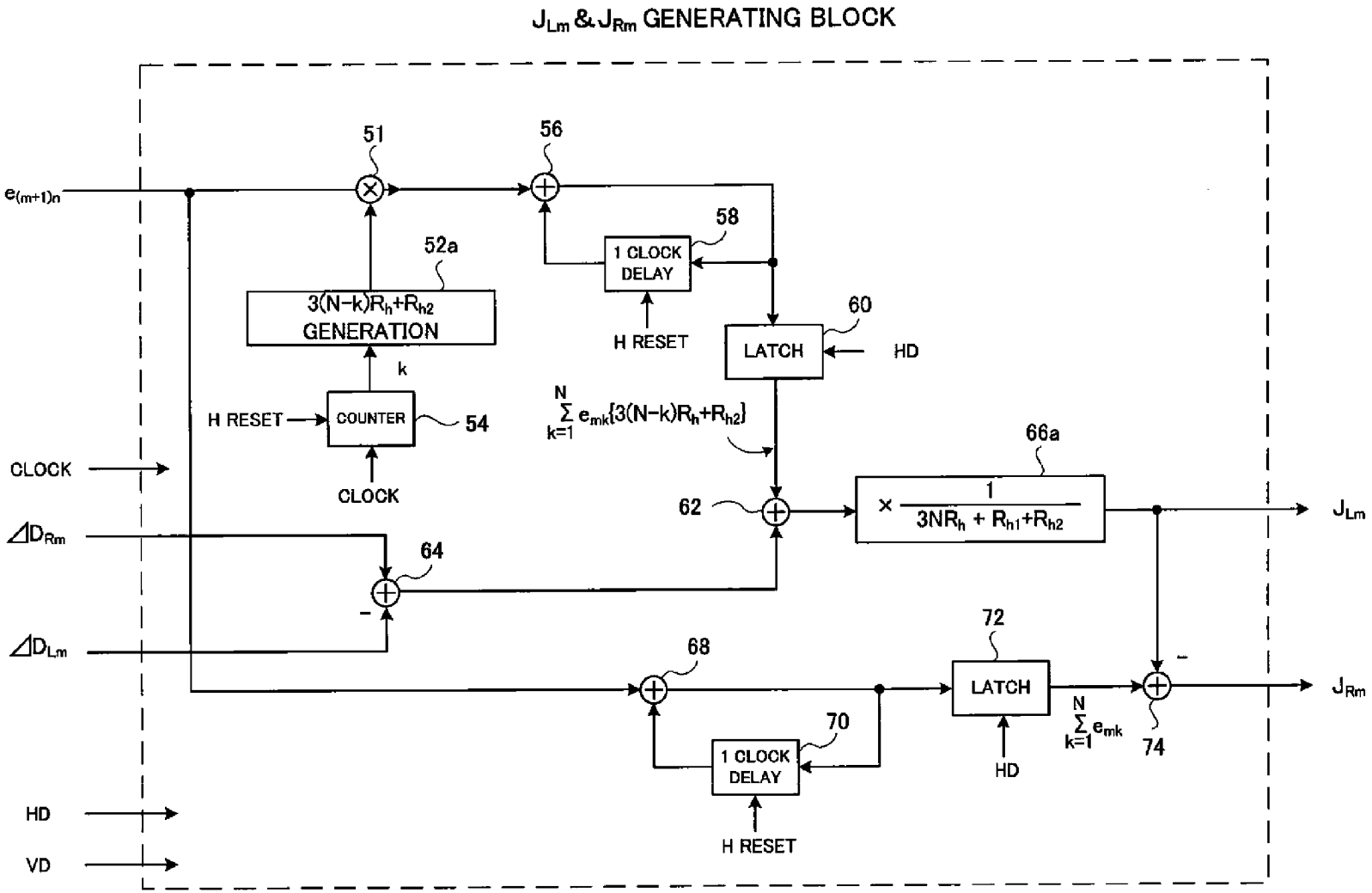
FIG. 15 is a drawing showing another structural example of a $J_{Lm}$ & $J_{Rm}$ generating block.

On the other hand, if it is considered that a voltage drop between three continuous RGB sub-pixels is extremely small and can be ignored, calculation of the voltage drop can also be carried out once in three continuous RGB pixels. If a situation is considered where $\Delta V_{mn}$ is defined as in FIG. 13 and three colors of RGB are provided with the same correction values, a block diagram of the γLUT and correction calculation, and the $J_{Lm}$ & $J_{Rm}$ generating section become as shown in FIG. 14 and FIG. 15. Also, in a generalized case where a number of sub-pixels is made P, the previously described proportional constant K for the $p^{th}$ sub-pixel is made $K_p$, input data for the $p^{th}$ pixel of an nth pixel of a horizontal line is made $d_{mpn}$, and correction data for an nth pixel of horizontal line m is made $D_{mn}$, $\Delta D_{mn}$ can be sequentially obtained from $\Delta D_{m(n-1)}$, as described in the following.

$$\Delta D_{m0} = J_{Lm}R_{h1} \qquad \text{Equation 15}$$

$$\Delta D_{m1} = \Delta D_{m0} + PR_h\left(J_{Lm} - A\sum_{j=1}^{P} K_j d_{mj1}\right) + AR_h\sum_{j=1}^{P} jK_j d_{mj1}$$

$$\Delta D_{m2} = \Delta D_{m1} + PR_h\left(J_{Lm} - A\sum_{j=1}^{P} K_j d_{j1} - A\sum_{j=1}^{P} K_j d_{mj2}\right) + AR_h\sum_{j=1}^{P} jK_j d_{mj2}$$

-continued $$\Delta D_{m3} = \Delta D_{m2} + PR_h\left(J_{Lm} - A\sum_{j=1}^{P} K_j d_{mj1} - A\sum_{j=1}^{P} K_j d_{mj2} - A\sum_{j=1}^{P} K_j d_{mj3}\right) + AR_h\sum_{j=1}^{P} jK_j d_{mj3}$$

$$\vdots$$

$$\Delta D_{mn} = \Delta D_{m(n-1)} + PR_h\left(J_{Lm} - A\sum_{k=1}^{n}\sum_{j=1}^{P} K_j d_{mjk}\right) + AR_h\sum_{j=1}^{P} jK_j d_{mjn}.$$

In FIG. 14, multiplication circuits 36, 44 for multiplying by proportional constants respectively multiply each signal of RGB, and each signal of RGB after one line delay, by AKr, AKg and AKb, and add the results together. Also, each RGB signal after one line delay is respectively multiplied by AKr, 2AKg, 3AKb in the multiplication circuit 120, the results are added together, and after that added to output of the multiplication circuit 45 by the adding circuit 126 by way of the multiplication circuit 122 for multiplying by Rh and the one clock delay circuit 124. The obtained $\Delta D_{mn}$ and $\Delta D_{Lm}$ are added in the adder 22, and that addition result is added to each of the RGB signals in the three adders 24.

Also, in the $J_{Lm}$ & $J_{Rm}$ generating circuit of FIG. 15, N−k) $R_h+R_{h2}$ from the 3 (N−k)$R_h+R_{h2}$ generating circuit 52*a* is supplied to the multiplier circuit 51. Multiplication by 1/(3 $NR_h+R_{h1}+R_{h2}$) is also carried out by the multiplier 66*a*.

Figure 16:
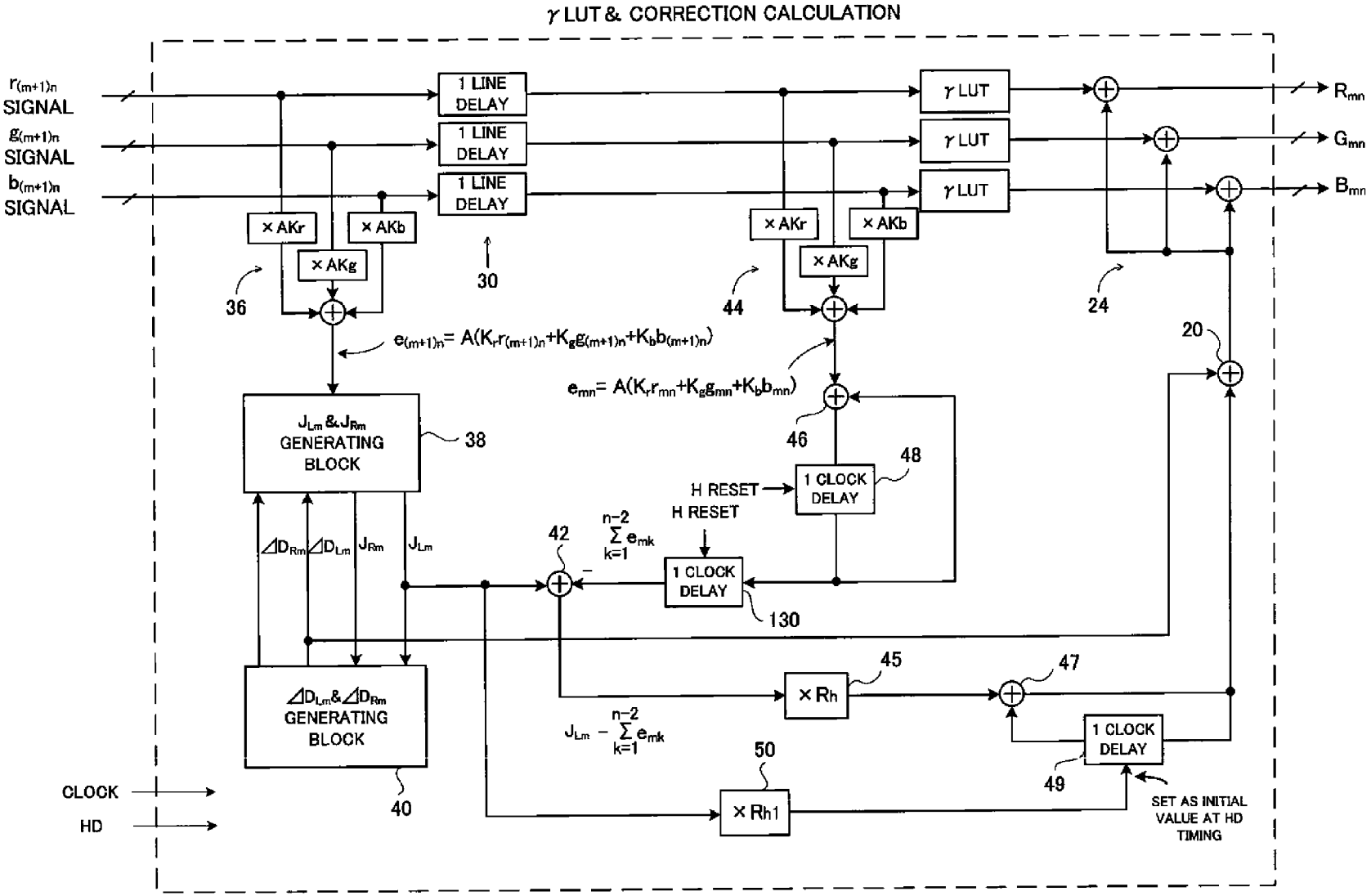
FIG. 16 is a drawing showing another structure of a γLUT and correction calculation circuit.
Figure 17A:
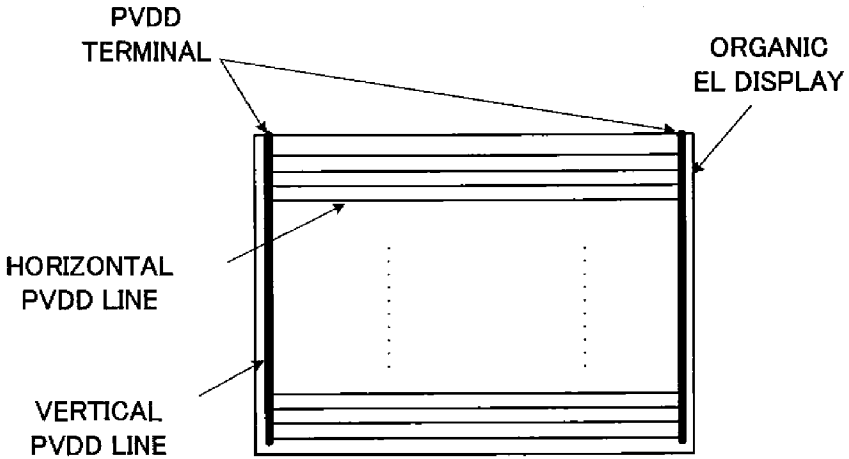
FIG. 17A is a drawing showing a structural example of a PVDD terminal.
Figure 17B:
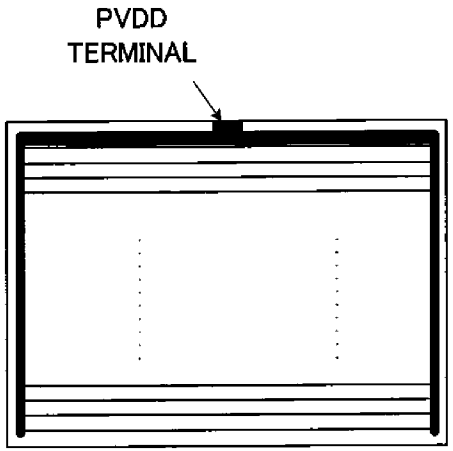
FIG. 17B is a drawing showing a structural example of a PVDD terminal.
Figure 17C:
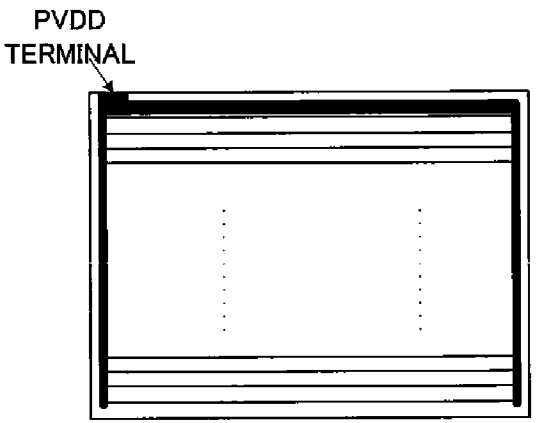
FIG. 17C is a drawing showing a structural example of a PVDD terminal.
Figure 17D:
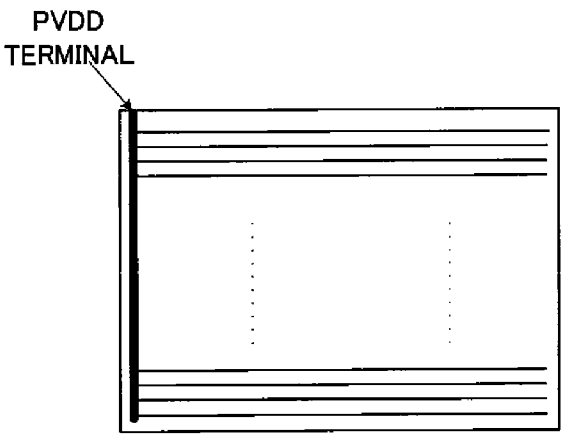
FIG. 17D is a drawing showing a structural example of a PVDD terminal.

Further, if it is considered that an error in the case where the term $AR_h\Sigma jK_j d_{mjn}$ (j=1~P) replaces $PAR_h\Sigma K_j d_{mjn}$ (j=1~P) can be ignored, it is possible to rewrite the equation for obtaining $\Delta D_{mn}$, as in equation 16 below. As shown in FIG. 16, instead of adding the one-clock delay circuit 130, it is possible to omit the multiplier 120, multiplier 122, one-clock delay circuit 124 and adder 126.

$$\Delta D_{m0} = J_{Lm}R_{h1} \qquad \text{Equation 16}$$

$$\Delta D_{m1} = \Delta D_{m0} + PR_h J_{Lm}$$

$$\Delta D_{m2} = \Delta D_{m1} + PR_h\left(J_{Lm} - A\sum_{j=1}^{P} K_j d_{mj1}\right)$$

$$\Delta D_{m3} = \Delta D_{m2} + PR_h\left(J_m - A\sum_{j=1}^{P} K_j d_{mj1} - A\sum_{j=1}^{P} K_j d_{mj2}\right)$$

$$\vdots$$

$$\Delta D_{mn} = \Delta D_{m(n-1)} + PR_h\left(J_{Lm} - A\sum_{k=1}^{n-1}\sum_{j=1}^{P} K_j d_{mjk}\right).$$

OTHER EXAMPLE

As wiring to external terminals from the vertical PVDD lines, various configurations can be considered, but some examples are shown in FIG. 17. With FIG. 17A, it is considered that current flows from only PVDD1 and PVDD3 in FIG. 6, and it is possible to calculate $q_L$ and $Q_L$ by making the term $\{(M-k)R_v+R_{v2}\}/(MR_v+R_{v1}+R_{v2})$ in equation 14 and equation 11, and the term $\{(M-k)R_v+R_{v4}\}/(MR_v+R_{v3}+R_{v4})$ in equation 7 and equation 14, 1. With FIG. 17B and FIG. 17C, it is possible perform calculations with resistance of wiring from the vertical PVDD lines of FIG. 17A to the terminals as $R_{v1}+R_v$ and $R_{v3}$, etc. In the case of FIG. 17D, there is only a left side vertical PVDD line. In this case, the term $\{(N-k)R_h+R_{h2}\}/(MR_h+R_{h1}+R_{h2})$ in equation 2 and equation 9 is made 1, and also $\Delta D_{Rm}-\Delta D_{Lm}$ is made 0 to calculate $j_{Lm}$ and $J_{Lm}$. It is also possible to calculate $q_L$ and $Q_L$ by making the term $\{(M-k)R_v+R_{v2}\}/(M R_v+R_{v1}+R_{v2})$ in equation 4 and equation 11, 1. In this case, since there is no problem of the previously described variation in voltage between both ends of the horizontal PVDD line when the image varies significantly, more accurate correction is made possible.

The invention has been described in detail with particular reference to certain preferred embodiments thereof, but it will be understood that variations and modifications can be effected within the spirit and scope of the invention.

PARTS LIST

1 drive TFT
2 selection TFT
3 EL element
10 source driver
10*a* shift register
10*b* D/A
12 gate driver
14 pixel section
16 correction circuit
18 display panel
20 calculation circuit
22 adder
24 adders
30 delay circuit
32 adder
34 adder
36 multiplier
38 generating block
40 generating block
42 adder
44 multiplier
45 multiplication circuit
46 adder
47 adder
48 delay circuit
49 generating block
51 multiplier
51 multiplier circuit
52 generating section
52*a* generating circuit
54 counter
56 adder
58 delay circuit
60 latch
62 adder
64 adder
66*a* multiplier
68 adder
70 delay circuit
72 latch
74 adder
80 delay circuit
80*r* delay circuit
82 adder
82*r* adder
84 counter
86 generating circuit
88 adder
90 multiplier
92 multiplier
92*r* multiplier
94 adder
96 latch
98 latch
100 adder
102 multiplier
104 adder
106 adder
108 latch
110 latch
112 multiplier
114 multiplier
116 adder
120 multiplication circuit
122 multiplication circuit
124 delay circuit
126 adding circuit

The invention claimed is:

1. A method of producing pixel current data signals for pixels on an EL display device, comprising:

(a) providing the EL display device having a plurality of pixels arranged in a matrix of rows and columns, each pixel including a self-emissive element that is responsive to a corresponding pixel current and a drive TFT that supplies the corresponding pixel current in response to the corresponding pixel current data signal;

(b) providing for each row of pixels in the matrix a corresponding first power supply line which supplies power to each pixel in the line, wherein the first power supply line is arranged in a first direction;

(c) providing on the EL display device a second power supply line arranged in a second direction different from the first direction, wherein the second power supply line has a corresponding resistance;

(d) connecting each of the plurality of first power supply lines to the second power supply line;

(e) receiving input pixel data corresponding to the pixel current for each pixel in the plurality of pixels;

(f) determining a voltage drop in each pixel in the first power supply line due to the resistance of the second power supply line;

(g) calculating correction data in response to the received input pixel data, such correction data corresponding to the determined voltage drop; and (h) adjusting the input pixel data in response to the correction data to produce the pixel current data signals so as to reduce influence of the voltage drop on the pixel current.

2. The method of claim 1, wherein the second direction is perpendicular to the first direction.

3. The method of claim 2, wherein the first direction is a horizontal scanning direction, and the second direction is a vertical scanning direction.

4. The method of claim 1, wherein each self-emissive element is an organic EL element.

5. The method of claim 1, wherein step (e) further includes providing gamma correction circuits for relating input pixel data to a corresponding pixel current, and computing the corresponding pixel currents for each input pixel data; and wherein step g) further includes using the corresponding pixel currents to calculate the correction data.

6. A method of producing pixel current data signals for pixels on an EL display device, comprising:

(a) providing the EL display device having a plurality of pixels arranged in a matrix of rows and columns, each pixel including a self-emissive element that is responsive to a corresponding pixel current and a drive TFT that supplies the corresponding pixel current in response to the corresponding pixel current data signal;

(b) providing for each row of pixels in the matrix a corresponding first power supply line which supplies power to each pixel in the line, wherein the first power supply line is arranged in a first direction;

(c) providing on the EL display device second and third power supply lines arranged in a second direction and a third direction, respectively, which are different from the first direction, wherein the second and third power supply lines have respective resistances;

(d) connecting each of the plurality of first power supply lines to the second power supply line and to the third power supply line;

(e) receiving input pixel data corresponding to the pixel current for each pixel in the plurality of pixels;

(f) determining a voltage drop in each pixel in the first power supply line due to the respective resistances of the second and third power supply lines;

(g) calculating correction data in response to the received input pixel data, such correction data corresponding to the determined voltage drop; and (h) adjusting the input pixel data in response to the correction data to produce the pixel current data signals so as to reduce influence of the voltage drop on the pixel current.

7. The method of claim 6, wherein the second and third directions are the same.

8. The method of claim 6, further including providing first and second memories corresponding to the second and third power supply lines, respectively, for saving a calculated value for current flowing into each first power supply line, in one frame period; and wherein step (f) includes using the calculated values stored in the first and second memories to calculate the correction data.

9. The method of claim 6, wherein the second and third power supply lines are arranged on either side of the matrix of pixels.

* * * * *